US010472997B2

(12) United States Patent
Mori

(10) Patent No.: US 10,472,997 B2
(45) Date of Patent: Nov. 12, 2019

(54) CAMSCHAFT FOR INTERNAL COMBUSTION ENGINE

(71) Applicant: HONDA MOTOR CO., LTD., Tokyo (JP)

(72) Inventor: Kensuke Mori, Wako (JP)

(73) Assignee: HONDA MOTOR CO., LTD., Tokyo (JP)

( * ) Notice: Subject to any disclaimer, the term of this patent is extended or adjusted under 35 U.S.C. 154(b) by 0 days.

(21) Appl. No.: 15/826,322

(22) Filed: Nov. 29, 2017

(65) Prior Publication Data

US 2018/0202325 A1 Jul. 19, 2018

(30) Foreign Application Priority Data

Jan. 16, 2017 (JP) ..... 2017-005099

(51) Int. Cl.

| | |
|---|---|
| ***F01L 1/02*** | (2006.01) |
| ***F01L 1/053*** | (2006.01) |
| *F01L 1/14* | (2006.01) |
| *F01L 1/047* | (2006.01) |

(52) U.S. Cl.

CPC ..... *F01L 1/053* (2013.01); *F01L 1/022* (2013.01); *F01L 1/143* (2013.01); *F01L 2001/0476* (2013.01); *F01L 2001/0537* (2013.01); *F01L 2810/03* (2013.01)

(58) Field of Classification Search

CPC . F01L 1/053; F01L 1/022; F01L 1/143; F01L 2810/03; F01L 2001/0476; F01L 2001/0537

See application file for complete search history.

(56) References Cited

U.S. PATENT DOCUMENTS 6,932,036 B2 * 8/2005 Aino ..... F01L 1/022 123/90.17

FOREIGN PATENT DOCUMENTS

JP 2010-25011 A 2/2010

* cited by examiner

*Primary Examiner* — Zelalem Eshete

(74) *Attorney, Agent, or Firm* — Birch, Stewart, Kolasch & Birch, LLP

(57) ABSTRACT

In a camshaft for an internal combustion engine, integrally including: a shaft main portion that extends linearly; a plurality of valve-actuating cams disposed to be spaced apart from each other in an axial direction of the shaft main portion; and a pair of support arms extending along one diametric line of the shaft main portion radially outwardly from one end part of the shaft main portion and being fitted with a follower rotational body, a pair of overhangs are integrated with the shaft main portion and the pair of support arms, the overhangs extending between the support arms in a peripheral direction of the shaft main portion, and a thick-wall portion having a larger thickness in a direction along an axis of the shaft main portion is formed in part, on a radially outer side of the shaft main portion, of each of the overhangs.

10 Claims, 5 Drawing Sheets

CAMSCHAFT FOR INTERNAL COMBUSTION ENGINE

BACKGROUND OF THE INVENTION

Field of the Invention

The present invention relates to a camshaft for an internal combustion engine, integrally comprising: a shaft main portion that extends linearly; a plurality of valve-actuating cams disposed to be spaced apart from each other in an axial direction of the shaft main portion; and a pair of support arms extending along one diametric line of the shaft main portion radially outwardly from one end part of the shaft main portion and being fitted with a follower rotational body for transmitting a rotational power to the shaft main portion.

Description of the Related Art

Japanese Patent Application Laid-open No. 2010-025011 discloses an arrangement that includes a camshaft, a pair of support arms disposed on one end part of the camshaft and extending along one diametric line of the camshaft radially outwardly, and a follower sprocket around which a cam chain is wound and that is fastened to the support arms.

A need exists for inertia mass intended for preventing fluctuations in rotation of the camshaft. A readily conceivable approach is to dispose, in place of the bifurcated support arms disclosed in Japanese Patent Application Laid-open No. 2010-025011, a thick-wall, disc-shaped flange on the one end part of the camshaft. Such a configuration, however, invites an increase in weight.

SUMMARY OF THE INVENTION

The present invention has been achieved in view of the above-mentioned circumstances, and it is an object thereof to provide a camshaft for an internal combustion engine, capable of yielding an effect of inertia mass, while preventing weight from increasing.

In order to achieve the object, according to a first feature of the present invention, there is provided a camshaft for an internal combustion engine, integrally comprising: a shaft main portion that extends linearly; a plurality of valve-actuating cams disposed to be spaced apart from each other in an axial direction of the shaft main portion; and a pair of support arms extending along one diametric line of the shaft main portion radially outwardly from one end part of the shaft main portion and being fitted with a follower rotational body for transmitting a rotational power to the shaft main portion, wherein a pair of overhangs are integrated with the shaft main portion and the pair of support arms, the overhangs extending between the support arms in a peripheral direction of the shaft main portion, and a thick-wall portion having a larger thickness in a direction along an axis of the shaft main portion is formed in part, on a radially outer side of the shaft main portion, of each of the overhangs.

With the first feature, the pair of overhangs is integrated with the shaft main portion and the support arms and the thick-wall portion is formed in part of each of the overhangs. Thus, weight can be prevented from increasing, while an effect of inertia mass can be achieved.

According to a second feature of the present invention, in addition to the first feature, the overhangs each include a boss portion that connects base end portions of the pair of support arms, the thick-wall portion, and a thin-wall portion that has a smaller thickness in the direction along the axis of the shaft main portion than thicknesses of the boss portion and the thick-wall portion and that connects the boss portion with the thick-wall portion.

With the second feature, the overhangs each include the boss portion that connects the base end portions of the pair of support arms, the thick-wall portion, and the thin-wall portion that connect the boss portion with the thick-wall portion, and the thin-wall portion is thinner than the boss portion and the thick-wall portion. Thus, the inertia mass effect can be achieved by the thick-wall portion and the thick boss portion can achieve rigidity of the overhang.

According to a third feature of the present invention, in addition to the second feature, the overhangs each have a recess that faces a side opposite to the follower rotational body mounted on the support arms and that is formed in the thin-wall portion that connects the boss portion with the thick-wall portion.

With the third feature, the overhangs each have the recess that faces the side opposite to the follower rotational body and that is formed in the thin-wall portion. Thus, the surface of each of the overhangs facing the follower rotational body serves as a flat surface flush with the support arms. The follower rotational body can thus be fixed to the support arms in tight contact with the overhangs, so that the follower rotational body can be rigidly fixed in position.

According to a fourth feature of the present invention, in addition to any one of the first to third features, the pair of thick-wall portions are formed to be symmetric with respect to the one diametric line.

With the fourth feature, the pair of thick-wall portions are formed symmetrically. Thus, fluctuations in rotation of the camshaft caused by the overhangs can be reduced.

According to a fifth feature of the present invention, in addition to the second or third feature, the thick-wall portion is formed into a semi-circular shape having an inner side edge of the thick-wall portion on a radially inner side of the shaft main portion, the inner side edge extending linearly in a longitudinal direction of the support arms, and the thin-wall portion is formed into a moldable shape.

With the fifth feature, the thick-wall portion is formed into the semi-circular shape having the inner side edge of the thick-wall portion, the inner side edge extending linearly in the longitudinal direction of the support arms and the thin-wall portion is formed into a moldable shape. Thus, molding of the overhangs is enabled.

According to a sixth feature of the present invention, in addition to the fifth feature, the inner side edge of the thick-wall portion is formed to have a draft angle during molding.

With the sixth feature, the inner side edge of the thick-wall portion has a draft angle, so that molding of the thin-wall portions through the use of a slide mold is easy.

According to a seventh feature of the present invention, in addition to the sixth feature, the boss portion is formed into an arc that is coaxial with the shaft main portion, and the inner side edge is formed to be symmetric with respect to an imaginary plane that passes through a central axis of the shaft main portion and that is orthogonal to the one diametric line, the inner side edge being inclined so as to be spaced apart from the one diametric line in going away from the imaginary plane.

With the seventh feature, the boss portion is formed into an arc and the inner side edge of the thick-wall portion is formed to be symmetric with respect to the imaginary plane that passes through the central axis of the shaft main portion and that is orthogonal to the one diametric line. Thus, the thin-wall portions can be easily molded using two slide molds that move along the direction of the pair of support arms.

According to an eighth feature of the present invention, in addition to any one of the first to third features, the follower rotational body has a lightening hole formed radially inside an outer periphery of the overhangs.

With the eighth feature, the follower rotational body has the lightening hole formed therein. Thus, even when the inertia mass effect of the follower rotational body itself is reduced, the thick-wall portions of the overhangs can make up for the reduction.

The above and other objects, characteristics and advantages of the present invention will be clear from detailed descriptions of the preferred embodiment which will be provided below while referring to the attached drawings.

DESCRIPTION OF THE PREFERRED EMBODIMENT

Figure 1:
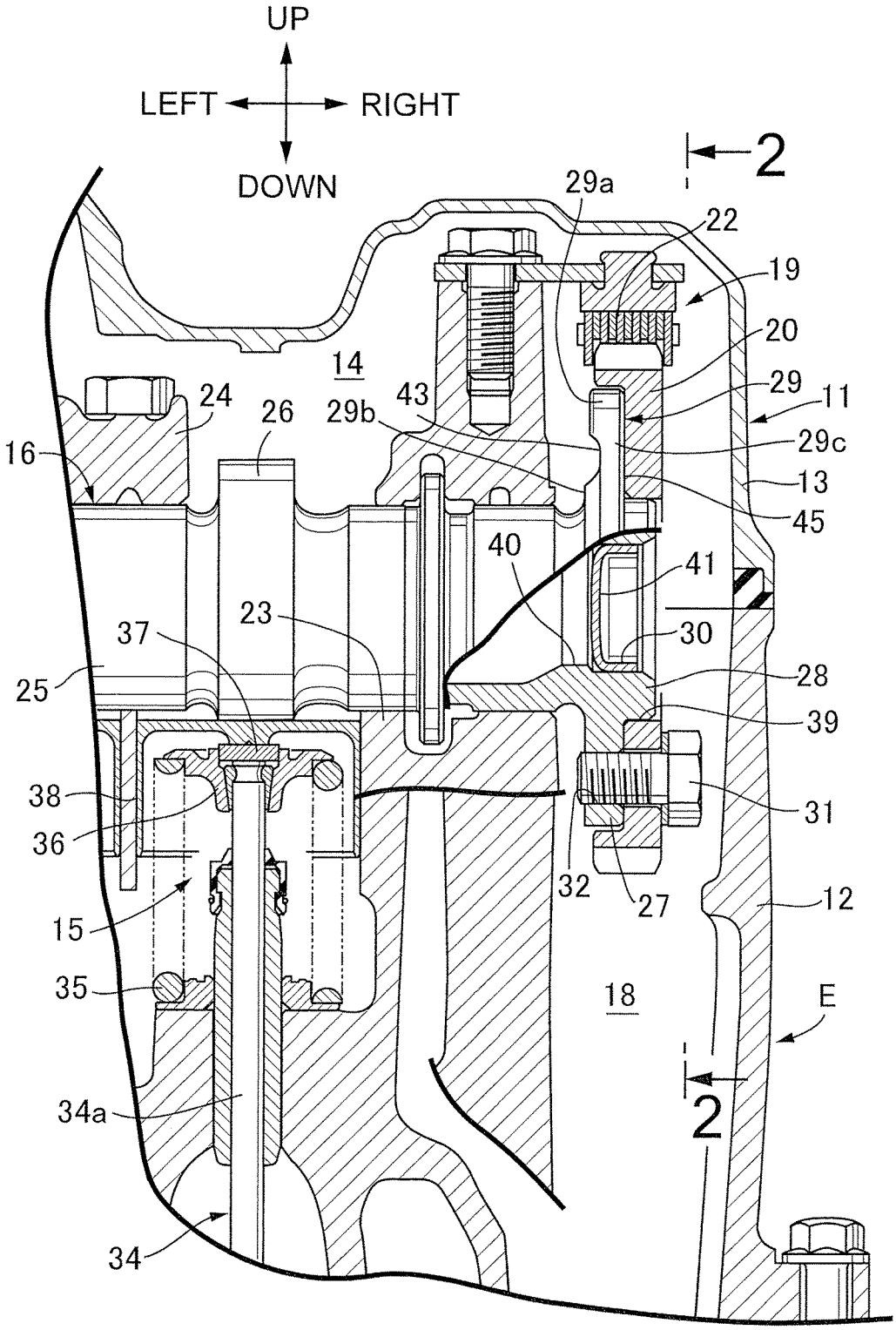
FIG. 1 is a longitudinal sectional view of one part of an internal combustion engine according to an embodiment of the present invention.
Figure 2:
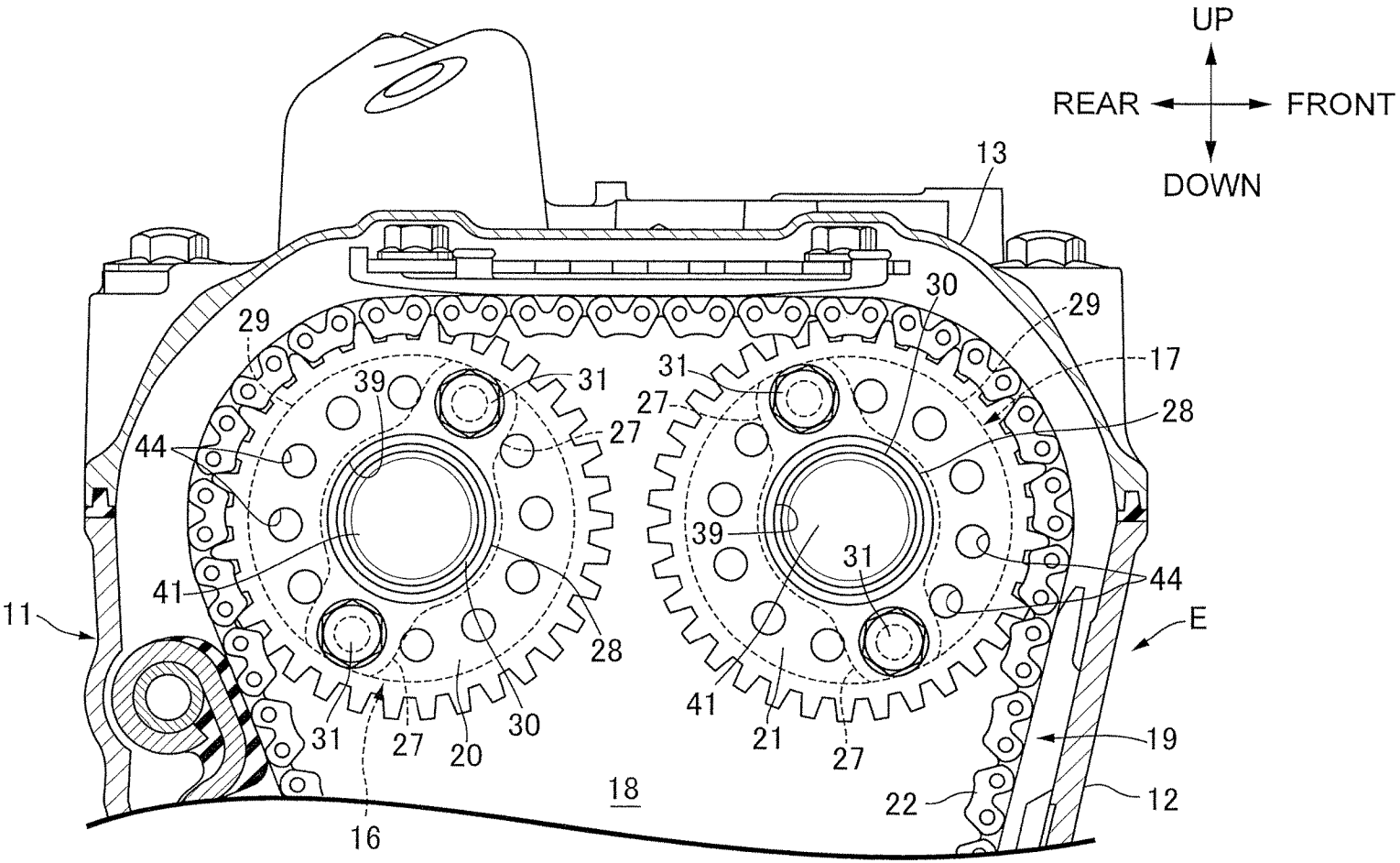
FIG. 2 is a sectional view taken along line 2-2 in FIG. 1.

An embodiment of the present invention will be described below with reference to FIGS. 1 to 5. Reference is first made to FIGS. 1 and 2. For example, an inline four-cylinder internal combustion engine E is mounted in, for example, a two-wheeled motor vehicle. An engine main unit 11 of the internal combustion engine E includes, as part of components thereof, a cylinder head 12 and a head cover 13 connected with the cylinder head 12. A valve-actuating mechanism 15 is housed in a valve train chamber 14 formed between the cylinder head 12 and the head cover 13.

The valve-actuating mechanism 15 includes camshafts 16 and 17 on an intake side and an exhaust side that extend in parallel with a crankshaft not depicted. The camshafts 16 and 17 each have one end part protruding into a cam chain chamber 18 formed in the engine main unit 11 including the cylinder head 12 and the head cover 13 and a rotational power from the crankshaft is transmitted via a timing transmission mechanism 19. In the embodiment, the engine main unit 11 is mounted in a vehicle body such that the cam chain chamber 18 is disposed on the right-hand side in a vehicle width direction. When the engine main unit 11 is mounted in the vehicle body, the intake-side camshaft 16 is disposed posterior to the exhaust-side camshaft 17 in a vehicle fore-aft direction.

The timing transmission mechanism 19 includes a drive sprocket (not depicted), follower sprockets 20 and 21, and a cam chain 22. The drive sprocket is disposed on the crankshaft. The follower sprockets 20 and 21 as follower rotational bodies are respectively disposed on the one end parts of the intake-side camshaft 16 and the exhaust-side camshaft 17. The cam chain 22 is wound around the drive sprocket and the follower sprockets 20 and 21 and travel inside the cam chain chamber 18. The intake-side camshaft 16 and the exhaust-side camshaft 17 are rotated at a rotational speed half of a rotational speed of the crankshaft through a rotational power transmitted from the timing transmission mechanism 19.

The intake-side camshaft 16 and the exhaust-side camshaft 17 are configured to have a basically identical structure. Although the following describes only the intake-side camshaft 16 and the explanation of the exhaust-side camshaft 17 is omitted, it is to be understood that the configuration of the intake-side camshaft 16 in the present application is also applicable to the exhaust-side camshaft 17.

Figure 3:
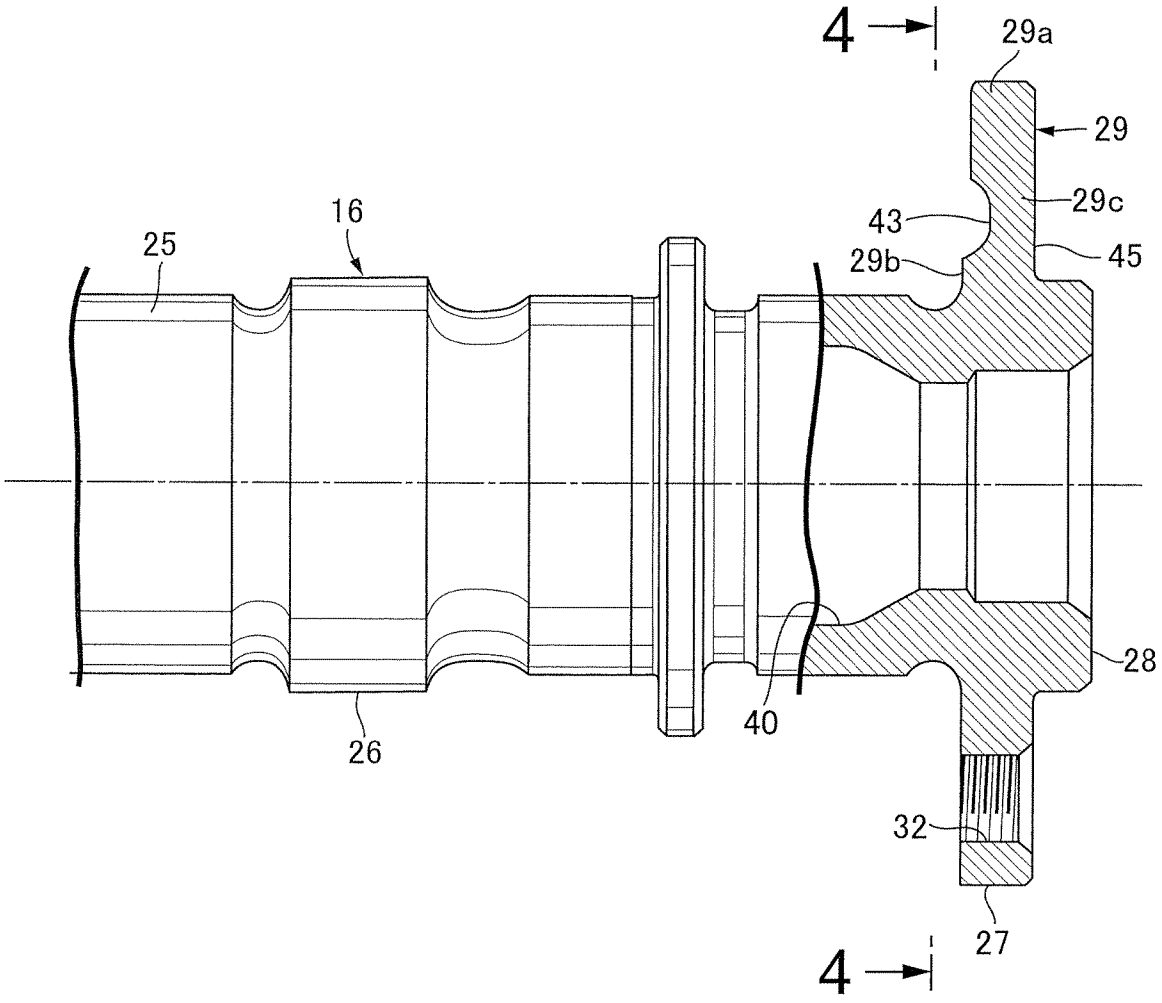
FIG. 3 is a longitudinal side view of a main part of a camshaft taken along line 3-3 in FIG. 4.

Reference is also made to FIG. 3. The intake-side camshaft 16 integrally includes a shaft main portion 25, a plurality of valve-actuating cams 26, and a pair of support arms 27. The shaft main portion 25 is rotatably supported by a shaft support 23 integrated with the cylinder head 12 and a cam holder 24 fastened to the shaft support 23 and extends linearly. The valve-actuating cams 26 are disposed to be spaced apart from each other in an axial direction of the shaft main portion 25. The pair of support arms 27 extend along one diametric line L of the shaft main portion 25 radially outwardly from one end part of the shaft main portion 25.

The follower sprocket 20 for transmitting the rotational power from the crankshaft to the shaft main portion 25 is mounted on the pair of support arms 27. In order to fasten the follower sprocket 20 to the support arms 27, the support arms 27 are each provided with a threaded hole 32 into which a bolt 31 is screwed, the bolt 31 being inserted through the follower sprocket 20.

In the cylinder head 12 in the embodiment, a pair of intake valves 34 are disposed for each of four cylinders. The intake valves 34 are each urged in a valve-closing direction by a valve spring 35. A valve lifter 38 having a bottomed cylindrical shape is abutted via a shim 37 against a retainer 36 that is fixed to an end of a valve stem 34*a* of the intake valve 34. The valve lifter 38 is slidably fitted to the shaft support 23. One pair of valve-actuating cams 26 are integrated with the shaft main portion 25 for each cylinder so as to slidably contact the valve lifters 38. Additionally, the support arms 27 are integrated with the one end part of the shaft main portion 25 and a fitting protrusion 28 integrally protrudes from the support arms 27 so as to be fitted in a mounting hole 39 formed in a central part of the follower sprocket 20. In the embodiment, the shaft main portion 25 is formed into a hollow cylindrical shape having a central hole 40. The fitting protrusion 28 is also formed into a cylindrical shape. The central hole 40 has one end part closed by a cap 41.

Figure 4:
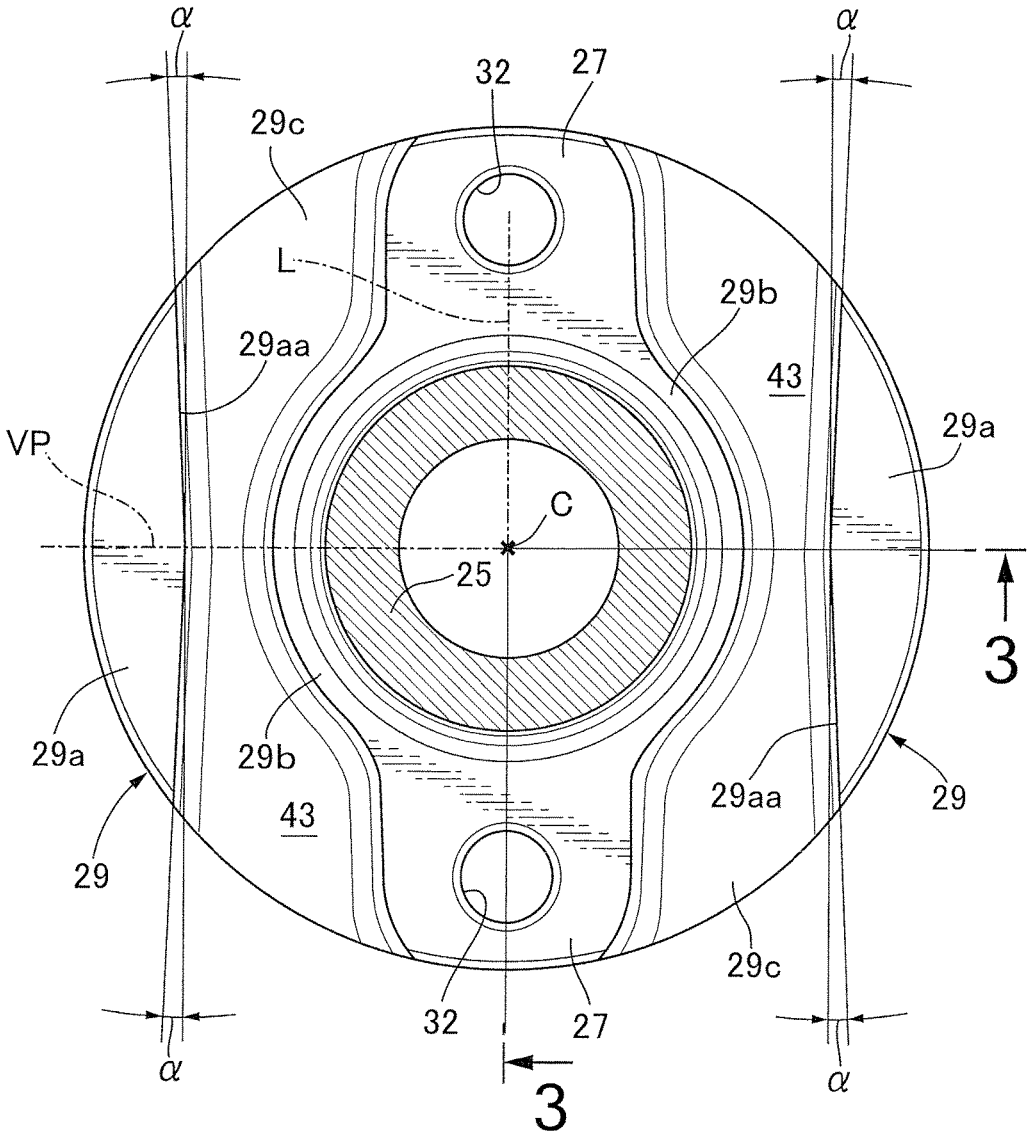
FIG. 4 is a sectional view taken along line 4-4 in FIG. 3.

Reference is also made to FIG. 4. The shaft main portion 25 and the pair of support arms 27 of the intake-side camshaft 16 are integrated with a pair of overhangs 29 extending between the support arms 27 in a peripheral direction of the shaft main portion 25. In the embodiment, the overhangs 29 are formed so that the pair of support arms 27 and the pair of overhangs 29 cooperate with each other so as to be formed into a disc shape.

A thick-wall portion 29*a* is formed in part, on a radially outer side of the shaft main portion 25, of each of the overhangs 29. The thick-wall portion 29*a* has a larger thickness in a direction along an axis of the shaft main portion 25. In the embodiment, the overhangs 29 each include a boss portion 29*b*, the thick-wall portion 29*a*, and a thin-wall portion 29*c*. The boss portion 29*b* connects base end portions of the pair of support arms 27. The thin-wall portion 29*c* has a smaller thickness in the direction along the axis of the shaft main portion 25 than thicknesses of the boss portion 29*b* and the thick-wall portion 29*a* and connects the boss portion 29*b* with the thick-wall portion 29*a*.

Additionally, the overhangs 29 each have a recess 43 that faces a side opposite to the follower sprocket 20 mounted on the support arms 27. The recess 43 is formed in the thin-wall portion 29*c* that connects the boss portion 29*b* with the thick-wall portion 29*a*. The overhangs 29 each have a surface 45 that faces the follower sprocket 20. The surface 45 is a flat surface flush with the support arms 27.

The thick-wall portion 29*a* is formed into a semi-circular shape having an inner side edge 29*aa* on a radially inner side of the shaft main portion 25, the inner side edge 29*aa* extending linearly in a longitudinal direction of the support arms 27. The thin-wall portion 29*c* is formed into a moldable shape. The pair of thick-wall portions 29*a* are formed to be symmetric with respect to the one diametric line L.

Additionally, the inner side edge 29*aa* of the thick-wall portion 29*a* is formed to have a draft angle during molding. The boss portion 29*b* is formed into an arc shape that is coaxial with the shaft main portion 25. The inner side edge 29*aa* is inclined at an inclination angle α so as to be spaced apart from the one diametric line L in going away from an imaginary plane VP that passes through a central axis C of the shaft main portion 25 and that is orthogonal to the one diametric line L. The inner side edge 29*aa* is further formed to be symmetric with respect to the imaginary plane VP.

Additionally, the follower sprocket 20 has a plurality of, for example, ten lightening holes 44 formed radially inside an outer periphery of the overhangs 29.

Operation of the embodiment will be described below. The intake-side camshaft 16 and the exhaust-side camshaft 17 each integrally include the shaft main portion 25 that extends linearly, the plurality of valve-actuating cams 26 disposed to be spaced apart from each other in the axial direction of the shaft main portion 25, and the pair of support arms 27 extending along the one diametric line L of the shaft main portion 25 radially outwardly from one end part of the shaft main portion 25 so as to mount the respective follower sprockets 20 and 21 to the support arms 27. In each of the intake-side camshaft 16 and the exhaust-side camshaft 17, the pair of overhangs 29 extending between the support arms 27 in the peripheral direction of the shaft main portion 25 are integrated with the shaft main portion 25 and the support arms 27. The thick-wall portion 29*a* having a larger thickness in the direction along the axis of the shaft main portion 25 is formed in part, on the radially outer side of the shaft main portion 25, of each of the overhangs 29. The foregoing configuration can prevent weight from increasing, while achieving an effect of inertia mass.

The overhangs 29 each include the boss portion 29*b* that connects the base end portions of the pair of support arms 27, the thick-wall portion 29*a*, and the thin-wall portion 29*c* that has a smaller thickness in the direction along the axis of the shaft main portion 25 than thicknesses of the boss portion 29*b* and the thick-wall portion 29*a* and connects the boss portion 29*b* with the thick-wall portion 29*a*. Thus, the inertia mass effect can be achieved by the thick-wall portion 29*a* and the thick boss portion 29*b* can achieve rigidity of the overhang 29.

The overhangs 29 each have the recess 43 that faces the side opposite to the follower sprocket 20 mounted on the support arms 27 and that is formed in the thin-wall portion 29*c* that connects the boss portion 29*b* with the thick-wall portion 29*a*. This configuration allows the surface 45 of each of the overhangs 29 facing the follower sprockets 20 and 21 to be a flat surface flush with the support arms 27. The follower sprockets 20 and 21 can thus be fixed to the support arms 27 in tight contact with the overhangs 29, so that the follower sprockets 20 and 21 can be rigidly fixed in position.

The pair of thick-wall portions 29*a* are formed to be symmetric with respect to the one diametric line L. This arrangement allows fluctuations in rotation of the intake-side camshaft 16 and the exhaust-side camshaft 17 caused by the overhangs 29 to be reduced.

The thick-wall portion 29*a* is formed into the semi-circular shape having the inner side edge 29*aa* on a radially inner side of the shaft main portion 25, the inner side edge 29*aa* extending linearly in the longitudinal direction of the support arms 27. The thin-wall portion 29*c* is formed into a moldable shape. The foregoing arrangement enables molding of the overhangs 29. Additionally, the inner side edge 29*aa* of the thick-wall portion 29*a* is formed to have a draft angle during molding. These arrangements facilitate molding of the thin-wall portions 29*c* through the use of a slide mold during cast molding of the intake-side camshaft 16 and the exhaust-side camshaft 17.

Figure 5:
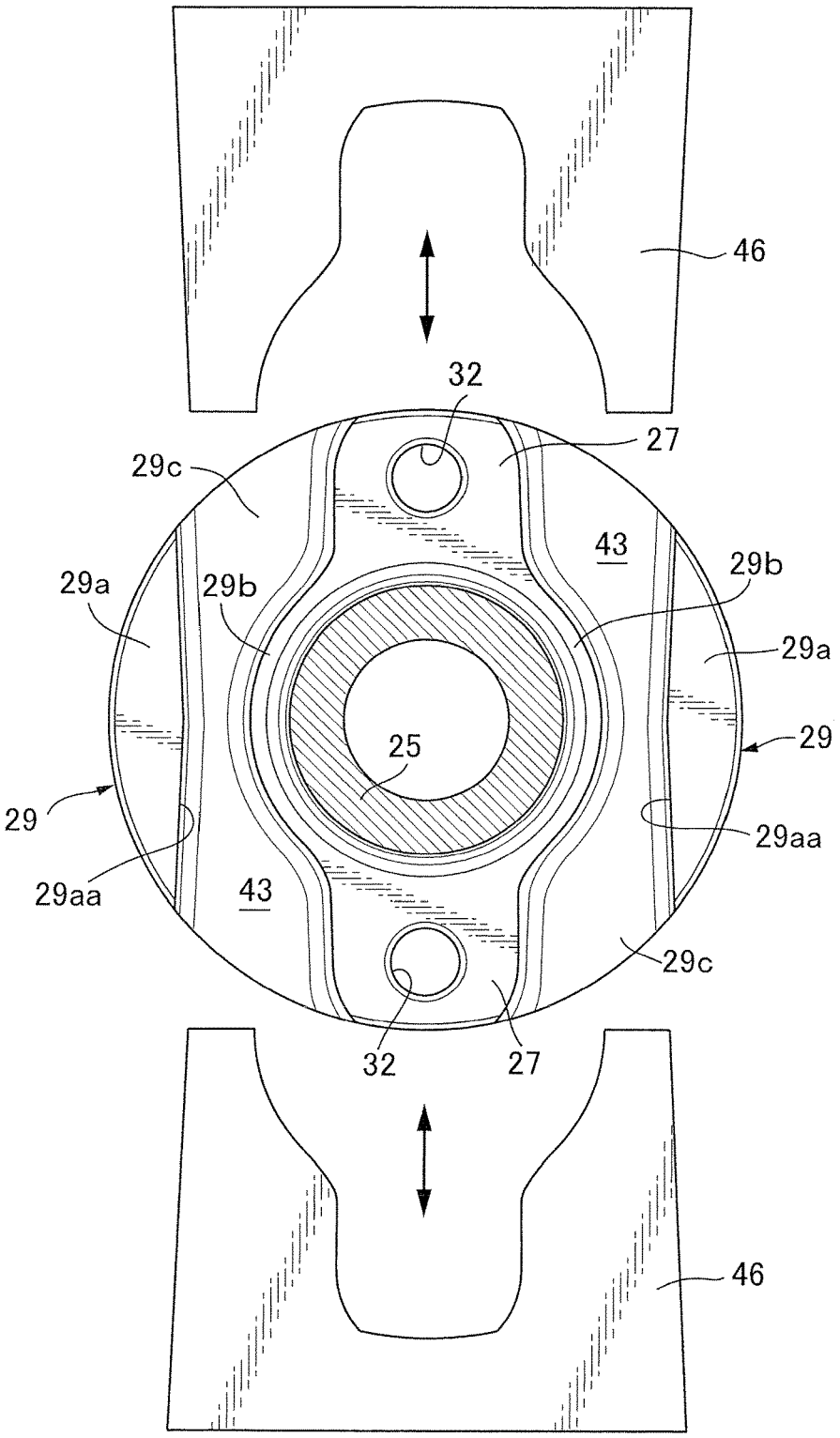
FIG. 5 is a sectional view corresponding to FIG. 4 upon completion of molding.

The boss portion 29*b* is formed into an arc shape that is coaxial with the shaft main portion 25. The inner side edge 29*aa* is inclined so as to be spaced apart from the one diametric line L in going away from the imaginary plane VP that passes through the central axis C of the shaft main portion 25 and that is orthogonal to the one diametric line L. The inner side edge 29*aa* is further formed to be symmetric with respect to the imaginary plane VP. Thus, as depicted in FIG. 5, the thin-wall portions 29*c* can be easily molded using two slide molds 46 that move in the direction along the pair of support arms 27 during cast molding.

Additionally, the follower sprockets 20 and 21 each have the lightening holes 44 formed radially inside the outer periphery of the overhangs 29. Thus, even when the inertia mass effect of the follower sprockets 20 and 21 themselves is reduced, the thick-wall portions 29*a* of the overhangs 29 can make up for the reduction.

An embodiment of the present invention is explained above, but the present invention is not limited to the above-mentioned embodiment and may be modified in a variety of ways as long as the modifications do not depart from the gist of the present invention.

What is claimed is:

1. A camshaft for an internal combustion engine, integrally comprising:

a shaft main portion that extends linearly;

a plurality of valve-actuating cams disposed to be spaced apart from each other in an axial direction of the shaft main portion;

a pair of support arms extending along one diametric line of the shaft main portion radially outwardly from one end part of the shaft main portion and being fitted with a follower rotational body for transmitting a rotational power to the shaft main portion; and a pair of overhangs integrated with the shaft main portion and the pair of support arms, the overhangs extending between the support arms in a peripheral direction of the shaft main portion, wherein a thick-wall portion having a larger thickness in a direction along an axis of the shaft main portion is formed in part, on a radially outer side of the shaft main portion, of each of the overhangs, and wherein the overhangs each include a boss portion that connects base end portions of the pair of support arms, the thick-wall portion, and a thin-wall portion that has a smaller thickness in the direction along the axis of the shaft main portion than thicknesses of the boss portion and the thick-wall portion and that connects the boss portion with the thick-wall portion.

2. The camshaft for an internal combustion engine according to claim 1, wherein the overhangs each have a recess that faces a side opposite to the follower rotational body mounted on the support arms and that is formed in the thin-wall portion that connects the boss portion with the thick-wall portion.

3. The camshaft for an internal combustion engine according to claim 1, wherein the thick-wall portion is formed into a semi-circular shape having an inner side edge of the thick-wall portion on a radially inner side of the shaft main portion, the inner side edge extending linearly in a longitudinal direction of the support arms, and the thin-wall portion is formed into a moldable shape.

4. The camshaft for an internal combustion engine according to claim 3, wherein the inner side edge of the thick-wall portion is formed to have a draft angle during molding.

5. The camshaft for an internal combustion engine according to claim 4, wherein the boss portion is formed into an arc that is coaxial with the shaft main portion, and the inner side edge is formed to be symmetric with respect to an imaginary plane that passes through a central axis of the shaft main portion and that is orthogonal to the one diametric line, the inner side edge being inclined so as to be spaced apart from the one diametric line in going away from the imaginary plane.

6. The camshaft for an internal combustion engine according to claim 1, wherein the pair of thick-wall portions are formed to be symmetric with respect to the one diametric line.

7. The camshaft for an internal combustion engine according to claim 2, wherein the pair of thick-wall portions are formed to be symmetric with respect to the one diametric line.

8. The camshaft for an internal combustion engine according to claim 2, wherein the thick-wall portion is formed into a semi-circular shape having an inner side edge of the thick-wall portion on a radially inner side of the shaft main portion, the inner side edge extending linearly in a longitudinal direction of the support arms, and the thin-wall portion is formed into a moldable shape.

9. The camshaft for an internal combustion engine according to claim 1, wherein the follower rotational body has a lightening hole formed radially inside an outer periphery of the overhangs.

10. The camshaft for an internal combustion engine according to claim 2, wherein the follower rotational body has a lightening hole formed radially inside an outer periphery of the overhangs.

* * * * *